US005342093A

United States Patent [19]

Weernink

[11] Patent Number: 5,342,093

[45] Date of Patent: Aug. 30, 1994

[54] WRAP AROUND LABEL

[75] Inventor: William C. Weernink, Savage, Minn.

[73] Assignee: Tursso Companies, Inc., St. Paul, Minn.

[21] Appl. No.: 16,785

[22] Filed: Feb. 11, 1993

[51] Int. Cl.[5] ..... B42D 15/00

[52] U.S. Cl. ..... 285/81; 40/310

[58] Field of Search ..... 283/81, 98, 99, 100; 40/299, 306, 310

[56] References Cited

U.S. PATENT DOCUMENTS

| | | | |
|---|---|---|---|
| 1,273,105 | 7/1918 | Van Dyke et al. . | |
| 1,756,944 | 5/1930 | Gorton . | |
| 1,896,834 | 2/1933 | Brown . | |
| 1,949,903 | 3/1934 | Fales | 35/12 |
| 2,015,268 | 9/1935 | Hammond | 206/58 |
| 2,706,865 | 4/1955 | Miller | 40/2 |
| 3,720,130 | 3/1973 | Holson | 40/104.18 |
| 4,128,954 | 12/1978 | White | 40/310 |
| 4,312,523 | 1/1982 | Haines | 283/18 |
| 4,318,235 | 3/1982 | Augeri | 40/306 |
| 4,324,058 | 4/1982 | Sherwick et al. | 40/310 |
| 4,700,976 | 10/1987 | Loose | 283/81 |
| 4,727,667 | 3/1988 | Ingle | 40/306 |
| 4,763,930 | 8/1988 | Matney | 283/81 |

*Primary Examiner*—Mark Rosenbaum
*Assistant Examiner*—Willmon Fridie, Jr.
*Attorney, Agent, or Firm*—Kinney & Lange

[57] ABSTRACT

An elongate strip label for being wrapped around a container includes a contact portion, an overlap portion, a transparent release coating and an adhesive coating. The transparent release coating covers a front surface of the contact portion. The adhesive coating covers a back surface of the contact portion and a back surface of the overlap portion. The adhesive coating adheres the back surface of the contact portion to the container and adheres the back surface of the overlap portion to the release coating on the front surface of the contact portion so that the overlap portion may be peeled away from the contact portion to expose the front surface of the contact portion.

9 Claims, 2 Drawing Sheets

WRAP AROUND LABEL

BACKGROUND OF THE INVENTION

The invention relates to wrap around labels, In particular, the invention relates to a wrap around label which has an overlap portion which adheres to a release coating covering the front surface of a contact portion.

In the marketing and dispensation of certain products, such as medicinal preparations, it is necessary that the container for a particular product be properly labeled. For such products, the proper label includes a wide range of information including the name of the product, its ingredients, the product's batch or lot number, the expiration date for use of the product and necessary instructions relating to the dispensing and use of the product. In addition, because the product may be distributed internationally, the information printed on the label must be in the appropriate language of the country where the product is to be distributed.

Unfortunately, the amount of information which can be located on a conventional label of a type which is entirely adhered to the surface of a container, such as a bottle, is limited by the surface area of the container. Because of this limited information space on the label, it was not possible to print the same information in multiple languages on one label. As a result, manufacturers and distributors were required to keep multiple inventories of containers, each inventory of containers having labels printed with information in the appropriate language.

To increase the amount of information which can be located on a label attached to a container, alternative labels have been employed. For example, U.S. Pat. No. 1,896,834, issued to R.R. Brown on Feb. 7, 1933, shows an elongated strip label which is folded to form a stack of sheets. The bottom sheet of the stack is adhered to the container. The top sheet of the stack is secured to an adjacent sheet to the maintain the label in a closed condition. With fold-out labels, the label must be generally folded before it is adhered to the container. As a result, intermediate folded layers cannot be inspected to insure against improper labeling after the label is attached. Moreover, fold-out labels require multiple manufacturing steps which adds both time and cost to the labeling process.

The second alternative for increasing the amount of information which can be located on a label adhered to a container is the use of a wrap around label which overlaps itself. The overlapping portion of these labels must have sufficient adherence to adhere to the underlying contact portion of the label which is adjacent the container. At the same time, however, the adherence of the overlap portion must be limited so as to allow the overlap portion to be peeled away from the underlying contact portion of the label. Ingle, U.S. Pat. No. 4,727,667, obtains this desired adherence by overprinting or overcoating the coating of adhesive with a pattern of non-adhesive composition to decrease the amount of the adhesive coating which is exposed on the back side of the overlapping portion. Applying a pattern of non-adhesive to only the adhesive on the back surface of the overlap portion adds both complexity and cost to the manufacture of this label.

SUMMARY OF THE INVENTION

The present invention is a wrap around label having a contact portion and an overlap portion. A front surface of the contact portion is covered with a release coating. An entire back surface of the label is covered with an adhesive which adheres a back surface of the contact portion to the container and which adheres a back surface of the overlap portion to the release coating on a front surface of the contact portion.

Because the release coating may be flood coated on the front surface of the contact portion rather than being patterned on the back surface of the overlap portion, the manufacture of the wrap around label is less complex and less costly. Because the overlap portion is adhered to the release coating and not to the front surface of the contact portion, the overlap portion may be peeled away to expose the information printed on the front surface of the contact portion. As a result, the amount of information which can be printed on the label is not limited by the surface area of the container. In addition, because of the increased information space, the label may contain information printed in multiple languages. This invention enables the manufacturer or the distributor to use a single multi-lingual label for each container.

In a preferred embodiment, the wrap around label also includes a central portion and a perforation line. The central portion is located between the contact portion and the overlap portion. The back surface of the central portion is covered with an adhesive which adheres the central portion to the container. Because the overlap portion does not overlap the central portion, information printed on the central portion, for example, an expiration date, is always exposed to the user. The perforation line is located between the central portion and the overlap portion. The perforation line permits the overlap portion to be torn away from the container to permanently expose the information printed on the front surface of the contact portion.

DETAILED DESCRIPTION OF THE PREFERRED EMBODIMENTS

Figure 1:
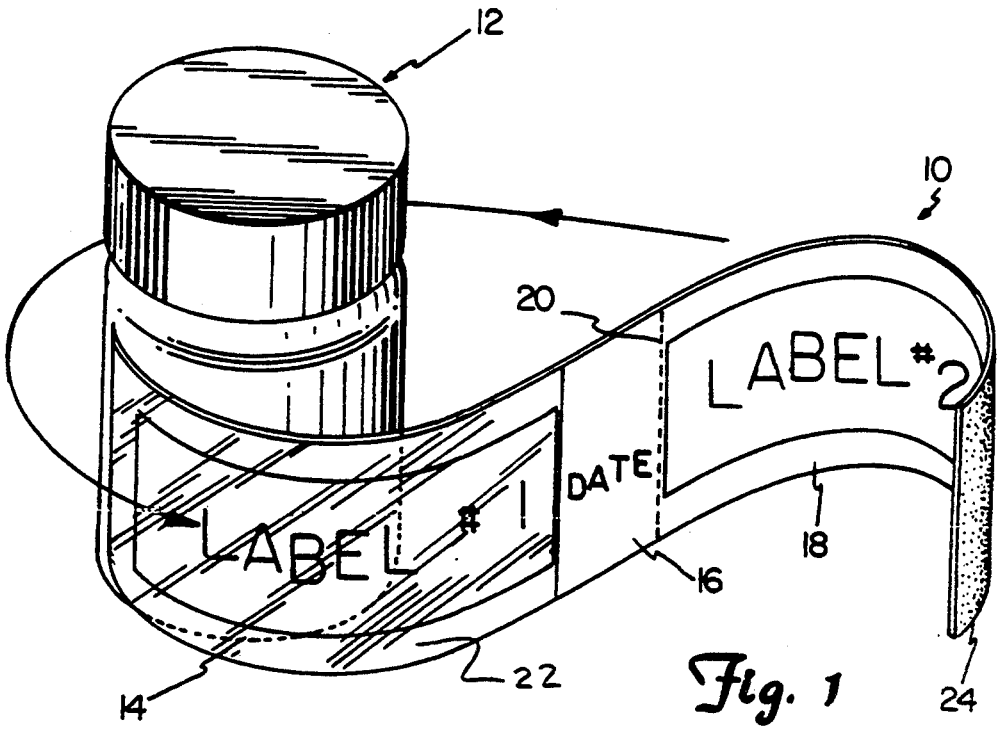
FIG. 1 is an illustrative view of an attachment of a label to an undersized container.
Figure 2:
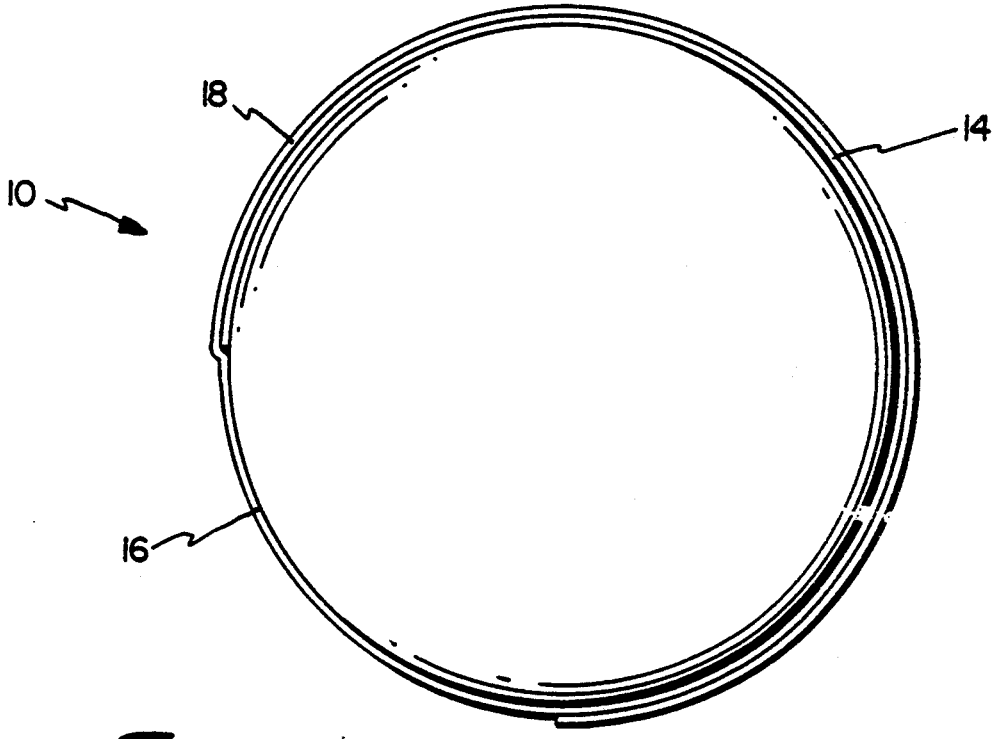
FIG. 2 is a bottom plan view of the label shown in FIG. 1 attached to the container.

FIGS. 1 and 2 show an attachment of wrap around label 10 to container 12. FIG. 1 shows an illustrative view of the attachment of wrap around label 10 to container 12. FIG. 2 shows a bottom plan view of label 10 wrapped around and attached to container 12. Label 10 includes first portion 14, central portion 16, second portion 18, release coating 22, adhesive coating 24 and perforation line 20. Central portion 16 is located between first portion 14 and second portion 18. First portion 14 and central portion 16, together, have a length substantially equal to an outer circumference of container 12. Second portion 18 has a length substantially equal to the length of first portion 14. As best shown in FIG. 2, label 10 is wrapped around container 12 so that first portion 14 and central portion 16 are adjacent to container 12 while second portion 18 overlaps first portion 14. Second portion 18 is an overlap portion which is adhered to release coating 22 on a front surface of a contact portion, first portion 14. Because central portion 16 is not overlapped by second portion 18, central portion 16 is always uncovered. Consequently, information printed on central portion 16, such as an expiration date, is always exposed.

Perforation line 20 extends between central portion 16 and second portion 18. Perforation line 20 permits second portion 18 to be torn away from first portion 14 and central portion 16. Consequently, information may be printed in a first language on first portion 14 and printed in a second language on second portion 18. If the material printed in the second language on second portion 18 is not the desired language, second portion 18 may be simply peeled and torn away from first portion 14 to permanently expose the material printed in the first language on first portion 14. In contrast, if the material printed in the second language on second portion 18 is the desired language while the material printed in the first language on first portion 14 is not the desired language, second portion 18 will be exposed while covering the undesired language printed on first portion 14.

Figure 3:
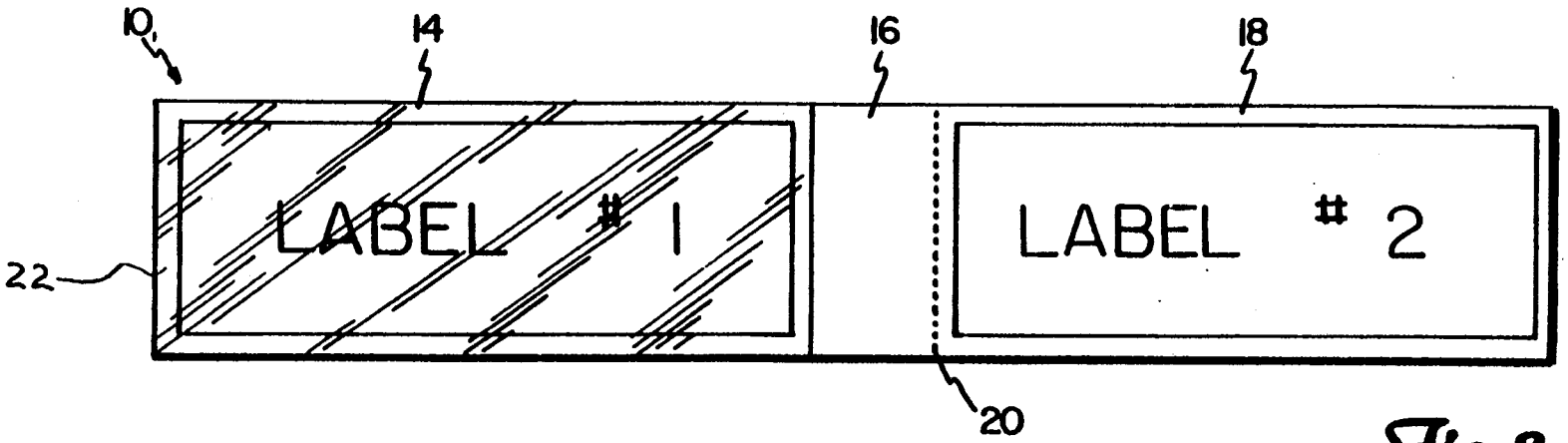
FIG. 3 is a front elevational view of the label shown in FIG. 1.
Figure 4:
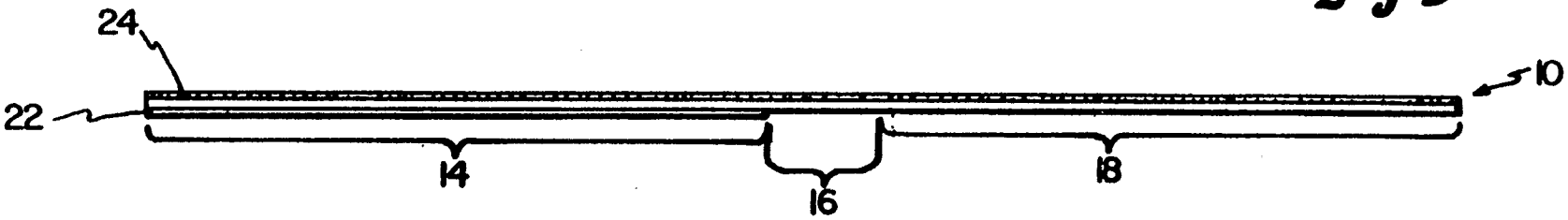
FIG. 4 is a diagrammatic cross-sectional view of the label shown in FIG. 1.

FIG. 3 shows a front surface of label 10. FIG. 4 shows a cross-sectional view taken from an edge of label 10. FIGS. 3 and 4 show that release coating 22 covers the front surface of first portion 14 while adhesive coating 24 covers a back surface of first portion 14, central portion 16, and second portion 18. Release coating 22 is preferably transparent and cured ultravioletly. Further, release coating 22 preferably comprises Sure Cure UV-S8800 overprint varnish. Release coating 22 is preferably flood coated on the front surface of first portion 14. However, any suitable application method, such as spot varnishing, may be used to apply coating 22 to the front surface of first portion 14.

Alternatively, release coating 22 may be applied to the front surface of first portion 14, central portion 16 and second portion 18. Because coating 22 may be flood coated on the front surface of first portion 14 rather than being patterned on the back surface of second portion 18, the manufacture of label 10 is less complex and less costly. Release coating 22 prevents adhesive coating 24 from permanently adhering second portion 18 to first portion 14, thus, permitting second portion 18 to be peeled away from first portion 14 to expose the printed material on the front surface of first portion 14. In addition, second portion 18 may be re-adhered to the release coating 22 on the front surface of first portion 14.

FIG. 4 shows that adhesive coating 24 covers the back surface of first portion 14, central portion 16 and second portion 18. Adhesive coating 24 must have sufficient adherence to permanently attach first portion 14 and central portion 16 to container 12. Suitable adhesives include Fasson DL50, Fasson S246 and 3M Converting Specialties Division 7604 Vinyl. Because adhesive coating 24 adheres second portion 18 to only release coating 22 on a front surface of first portion 14, second portion 18 may be peeled away from release coating 22 and the front surface of first portion 14 to expose printed material on the front surface of first portion 14. As a result, a larger amount of information may be printed on label 10. This additional information space allows label 10 to have information printed in more than one language.

Figure 5:
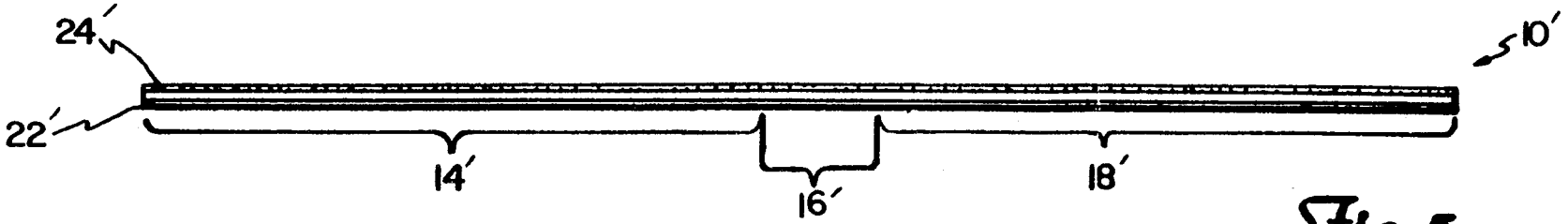
FIG. 5 is a diagrammatic cross-sectional view of an alternate embodiment of the label shown in FIG. 1.

FIG. 5 shows an alternate embodiment 10' of label 10. Label 10' has release coating 22' which covers the front surface of first portion 14', central portion 16' and second portion 18'. Because adhesive coating 24' adheres second portion 18' to only release coating 22' on a front surface of first portion 14', second portion 18' may be peeled away from release coating 22' on the front surface of first portion 14' to expose printed material on the front surface of first portion 14'.

Although the present invention has been described with reference to preferred embodiments, workers skilled in the art will recognize that changes may be made in form and detail without departing from the spirit and scope of the invention.

What is claimed is:

1. An elongated strip-like label for being wrapped around a container, the label comprising:

a first portion having a front surface and a back surface;

a second portion coupled to the first portion, the second portion having a front surface and a back surface;

a release coating covering the front surface of the first portion; and an adhesive coating covering the back surface of the first portion and the back surface of the second portion for adhering the back surface of the first portion to the container and for adhering the back surface of the second portion to the release coating on the front surface of the first portion so that the second portion may be peeled away from the first portion to expose the front surface of the first portion.

2. The label of claim 1 further comprising a perforation separating the first portion and the second portion so that the second portion may be torn away from the first portion.

3. The label of claim 1 further comprising:

a central portion in between the first portion and the second portion, the central portion having a front surface and a back surface, wherein the front surface of the central portion is not overlapped by the second portion; and an adhesive coating covering the back surface of the central portion for adhering the back surface of the central portion to the container.

4. An elongate strip label for being wrapped around a container having an outer circumference, the label comprising:

a contact portion having a front surface, a back surface and a length substantially equal to the outer circumference of the container;

an overlap portion coupled to the contact portion, the overlap portion having a front surface and a back surface, the overlap portion overlapping the contact portion;

a transparent release coating covering the front surface of the contact portion; and an adhesive release coating covering the back surface of the contact portion and the back surface of the overlap portion for adhering the back surface of the contact portion to the container and for adhering the back surface of the overlap portion to the release coating on the front surface of the contact portion so that the overlap portion may be peeled away from the contact portion to expose the front surface of the contact portion.

5. The label of claim 4 further comprising:

a central portion in between the contact portion and the overlap portion, the central portion having a front surface and a back surface, wherein the front surface of the central portion is not overlapped by the overlap portion; and an adhesive coating covering the back surface of the central portion for adhering the back surface of the central portion to the container.

6. The label of claim 4 comprising:

a perforation between the contact portion and the overlap portion, the perforation permitting the overlap portion to torn away from the contact portion.

7. The label of claim 5 further comprising:

a perforation between the central portion and the overlap portion, the perforation permitting the overlap portion to be torn away from the central portion.

8. An elongated strip label for being wrapped around an outer circumference of a container, the label comprising:

a contact portion having a front surface, a back surface, and a length less than the outer circumference of the container;

a central portion adjacent the contact portion, the central portion having a front surface, a back surface, and a length so that the length of the contact portion and the length of the central portion is substantially equal to the outer circumference of the container;

an overlap portion adjacent the central portion having a front surface, a back surface and a length substantially equal to the length of the contact portion;

a transparent release coating covering the front surface of the contact portion; and an adhesive coating covering the back surface of the contact portion, the back surface of the central portion and the back surface of the overlap portion for adhering the back surface of the contact portion and the back surface of the central portion to the container and for adhering the back surface of the overlap portion to the release coating on the front surface of the contact portion so that the overlap portion may be peeled away from the contact portion to expose the front surface of the contact portion.

9. The label of claim 8 comprising a perforation between the central portion and the overlap portion, the perforation permitting the overlap portion to be torn away from the central portion.

* * * * *

UNITED STATES PATENT AND TRADEMARK OFFICE

CERTIFICATE OF CORRECTION

PATENT NO. : 5,342,093

DATED : August 30, 1994

INVENTOR(S) : WILLIAM C. WEERNINK

It is certified that error appears in the above-indentified patent and that said Letters Patent is hereby corrected as shown below:

Col. 1, line 5, after "labels", delete ",", insert a --.--

Col. 3, line 33, delete "UV-S8800", insert --UV-8800--

Col. 4, line 59, after "adhesive", delete "release"

Signed and Sealed this

Seventeenth Day of January, 1995

*Attest:*

Bruce Lehman

BRUCE LEHMAN

*Attesting Officer*

*Commissioner of Patents and Trademarks*